US011378076B1

(12) United States Patent
Kanatani et al.

(10) Patent No.: US 11,378,076 B1
(45) Date of Patent: Jul. 5, 2022

(54) GEAR PUMP OR MOTOR

(71) Applicant: SHIMADZU CORPORATION, Kyoto (JP)

(72) Inventors: Kenichi Kanatani, Kyoto (JP); Takahiro Kono, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 17/161,607

(22) Filed: Jan. 28, 2021

(51) Int. Cl.

| | |
|---|---|
| ***F01C 1/16*** | (2006.01) |
| ***F03C 2/00*** | (2006.01) |
| ***F03C 4/00*** | (2006.01) |
| ***F04C 18/00*** | (2006.01) |
| ***F04C 2/00*** | (2006.01) |
| ***F04C 2/16*** | (2006.01) |
| ***F04C 15/06*** | (2006.01) |
| ***F04C 13/00*** | (2006.01) |

(52) U.S. Cl.
CPC ..... *F04C 2/16* (2013.01); *F04C 13/001* (2013.01); *F04C 15/06* (2013.01)

(58) Field of Classification Search
CPC ..... F04C 2/14; F04C 2/16; F04C 2/18; F04C 13/001; F04C 15/06
See application file for complete search history.

(56) References Cited

U.S. PATENT DOCUMENTS

| | | | | |
|---|---|---|---|---|
| 2,531,726 A * | 11/1950 | Durdin | ..... | F04C 15/06 418/206.4 |
| 5,388,974 A * | 2/1995 | Streiff | ..... | F04C 15/06 418/206.4 |
| 6,283,734 B1 * | 9/2001 | Blume | ..... | F04C 2/084 418/206.1 |

FOREIGN PATENT DOCUMENTS

| | | | | |
|---|---|---|---|---|
| JP | 2001336482 | 12/2001 | | |
| JP | 2008163759 | 7/2008 | | |
| JP | 2017223197 | 12/2017 | | |
| WO | 2014141377 | 9/2014 | | |
| WO | WO-2020183546 A1 * | 9/2020 | ..... | F04C 18/16 |

OTHER PUBLICATIONS

"Office Action of Japan Counterpart Application" with English translation thereof, dated Oct. 12, 2021, p. 1-p. 10.

* cited by examiner

*Primary Examiner* — Theresa Trieu
(74) *Attorney, Agent, or Firm* — JCIPRNET

(57) ABSTRACT

A gear pump is capable of maintaining the pump volumetric efficiency for preferably supplying a hydraulic liquid while adequately securing a sealing area, even if a cross sectional area of a flow-in passage is increased. The cross section of a suction passage has a rectangular shape in a side close to a hollow space in a body, and has a circular shape in the outside of the body. The rectangular shape of the suction passage in the hollow space side in the body has a long side extending in a direction along the tooth width of the spur gears, and a short side extending along a direction perpendicular to the tooth width direction. The suction passage has a shape that smoothly connects the rectangular shape in the hollow space side in the body with the circular shape in the outside of the body.

8 Claims, 12 Drawing Sheets

(RELATED ART)

(RELATED ART)

GEAR PUMP OR MOTOR

TECHNICAL FIELD

The present invention relates to a motor or a gear pump including a hydraulic gear pump. The motor or the gear pump is used for power conversion in various apparatuses.

BACKGROUND ART

A hydraulic gear pump includes: a pair of spur gears housed in a hollow space provided in a body with the spur gears meshing with each other; a driving axle and a driven axle of the respective spur gears; a suction passage for supplying hydraulic oil as working liquid provided in a low-pressure area in which the spur gears separate; and a discharge passage for discharging the hydraulic oil from the hollow space provided in a high-pressure area in which the spur gears mesh (see Patent literature 1).

Furthermore, a hydraulic helical gear pump that uses helical gears in place of spur gears has also been proposed (see Patent Literature 2). The helical gears are characterized by quietness and continuous tooth contact without containment.

FIG. 14 is a sectional side view around a body 11 of a traditional hydraulic gear pump in which spur gears are used.

In the hydraulic gear pump, a pair of spur gears 23 and 24 that mesh with each other are housed in a hollow space 19 provided in the body 11 which is called a spectacle-shaped hole. The spur gear 23 is fixed to a driving axle 21 rotated by a motor which is not shown. The spur gear 24 is fixed to a driven axle 22. The spur gears 23 and 24, meshing with each other, are rotated by the driving axle 21 in the respective directions indicated by the arrows in FIG. 14.

In the low-pressure area where teeth of the paired spur gears 23 and 24 in the hollow space 19 provided in the body 11 separate from each other, a suction passage 31 is formed for supplying hydraulic oil to the hollow space 19. In the high-pressure area where teeth of the paired spur gears 23 and 24 in the hollow space 19 provided in the body 11 mesh, a discharge passage 33 is formed for discharging hydraulic oil from the hollow space 19.

FIG. 15 is a sectional view taken along line B-B in FIG. 14, and shows the suction passage 31 viewed from the hollow space 19 and outside of the body 11.

As shown in FIG. 15, the suction passage 31 has a circular cross section. The discharge passage 33 also has a circular cross section, like the suction passage 31.

CITATION LIST

Patent Literature

Patent Literature 1: JP 2008-163759 A
Patent Literature 2: WO 2014/141377 A

If the capacity of the hydraulic gear pump is to be increased, the flow rate of the hydraulic oil sucked by the pump is also increased. Thus, it is necessary to prepare the suction passage 31 with a large scale. However, the opening of the large-scaled suction passage 31 interferes with the outskirt of the low-pressure area in the hollow space 19, since the cross section of the suction passage 31 has a circular shape as mentioned earlier. The areas L shown in FIG. 14 serve as sealing areas for preventing hydraulic oil from leaking from the high-pressure area toward the low-pressure area, owing to the sealing effect between the inner peripheral face of the hollow space 19 and tooth tips of the spur gears 23 and 24. Accordingly, if the cross sectional area of the suction passage 31 is increased, the opening of the suction passage 31 interferes with the sealing area L. This prevents the sealing area L from adequately functioning. If the sealing area L is reduced, the pump volumetric efficiency, defined as a ratio between an actual discharge amount by the hydraulic gear pump and its theoretical discharge amount, deteriorates.

Meanwhile, if, despite an increase in the capacity of the pump, the suction passage 31 is not enlarged, the flow velocity of the hydraulic oil should increase due to the small opening area of the suction passage. This causes the generation of cavitation.

The present invention is made for solving the aforementioned problems. An object of the present invention is to provide a gear pump or a motor, in which the sealing area is adequately secured and the pump volumetric efficiency is maintained even if the cross sectional area of the flow-in passage is increased, to thereby supply a hydraulic liquid in a preferable manner.

SUMMARY OF INVENTION

The invention includes: a pair of gears housed in a hollow space provided in a body, in a state where the gears mesh with each other; a suction passage for supplying a hydraulic liquid to the hollow space; and a discharge passage for discharging the hydraulic liquid from the hollow space. The suction passage has an opening with respect to the hollow space, and the dimension of the opening in the direction along the tooth width of the gear is larger than the dimension of the opening in the direction perpendicular to the direction along the tooth width of the gear.

In the invention, the dimension of the opening, of the suction passage, with respect to the hollow space in the direction along the tooth width of the gear is larger than the dimension, in the direction along the tooth width of the gear, of the opening of the suction passage in the side from which the hydraulic liquid is supplied, and the dimension of the opening, of the suction passage, with respect to the hollow space in the direction perpendicular to the direction along the tooth width of the gear is smaller than the dimension, in the direction perpendicular to the direction along the tooth width of the gear, of the opening of the suction passage in the side from which the hydraulic liquid is supplied.

In the invention, the opening of the suction passage in the side from which the hydraulic liquid is supplied is shaped in a circle, the dimension of the opening of the suction passage with respect to the hollow space in the direction along the tooth width of the gear is larger than the diameter of the circle, and the dimension of the opening, of the suction passage, with respect to the hollow space in the direction perpendicular to the direction along the tooth width of the gear is smaller than the diameter of the circle.

In the invention, the cross sectional area of the suction passage is constant from the opening in the side from which the hydraulic liquid is supplied to the opening with respect to the hollow space.

In the invention, the gear is a spur gear, and the opening of the suction passage with respect to the hollow space has opposite ends with respect to the direction perpendicular to the direction along the tooth width of the spur gear parallel to the tooth tip line of the spur gear in an area, of the opening, which faces the spur gear.

In the invention, the gear is a helical gear, and the dimension of the opening, of the suction passage, with respect to the hollow space in the direction perpendicular to the direction along the tooth width of the helical gear is larger in the side where helical gears which are paired and mesh with each other separate earlier and smaller in the side where the paired helical gears meshing with each other separate later, in an area, of the opening, which faces the helical gears.

In the invention, the opening of the suction passage with respect to the hollow space has opposite ends in the direction perpendicular to the direction along the tooth width of the helical gears, and each of the opposite ends is shaped in a sine curve corresponding to the tooth tip line of the helical gears, in the area of the opening, which faces the helical gears.

The invention includes: a pair of helical gears housed in a hollow space provided in a body, in a state where the helical gears mesh with each other; a suction passage for supplying a hydraulic liquid to the hollow space; and a discharge passage for discharging the hydraulic liquid from the hollow space. The opening of the suction passage with respect to the hollow space has a dimension in the direction perpendicular to the direction along the tooth width of the helical gears. The dimension is larger in the side where the helical gears that are paired and mesh with each other separate earlier and smaller in the side where the paired helical gears meshing with each other separate later, in the area, of the opening, which faces the helical gears.

In the invention, the opening of the suction passage with respect to the hollow space has opposite ends in the direction perpendicular to the direction along the tooth width of the helical gears shaped in a sine curve corresponding to the tooth tip line of the helical gears, in the area of the opening, which faces the helical gears.

According to the invention, the cross sectional area of the suction passage can be increased while the sealing area between the inner peripheral face of the hollow space and the tooth tips of the gear is secured. Accordingly, it is possible to prevent the pump volumetric efficiency from deteriorating due to reduction in the flow rate of the hydraulic liquid. In addition, it is possible to prevent cavitation by controlling the occurrence of defective suction, to thereby enable a prolonged product life.

According to the invention, the dimension of the opening in the direction along the tooth width of the gear is increased while the cross sectional area of the suction passage is kept constant. This can reduce the dimension of the opening in the direction perpendicular to the direction along the tooth width of the spur gear. Therefore, it is possible to efficiently increase the cross sectional area of the suction passage, while the sealing area between the inner peripheral face of the hollow space and the tooth tips of the spur gear is secured.

According to the invention, the suction passage can be connected to a hydraulic-liquid supply tube or the like, using a commonly-used apparatus.

According to the invention, the hydraulic liquid can be smoothly supplied from the suction passage to the hollow space.

According to the invention, when spur gears are used as the paired gears, it is possible to efficiently increase the cross sectional area of the suction passage while the sealing area between the inner peripheral face of the hollow space and the tooth tips of the gear is secured.

According to the inventions, when helical gears are used as the paired gears, it is possible to further efficiently increase the cross sectional area of the suction passage while the sealing area between the inner peripheral face of the hollow space and the tooth tips of the gear is secured.

DESCRIPTION OF EMBODIMENTS

Figure 1:
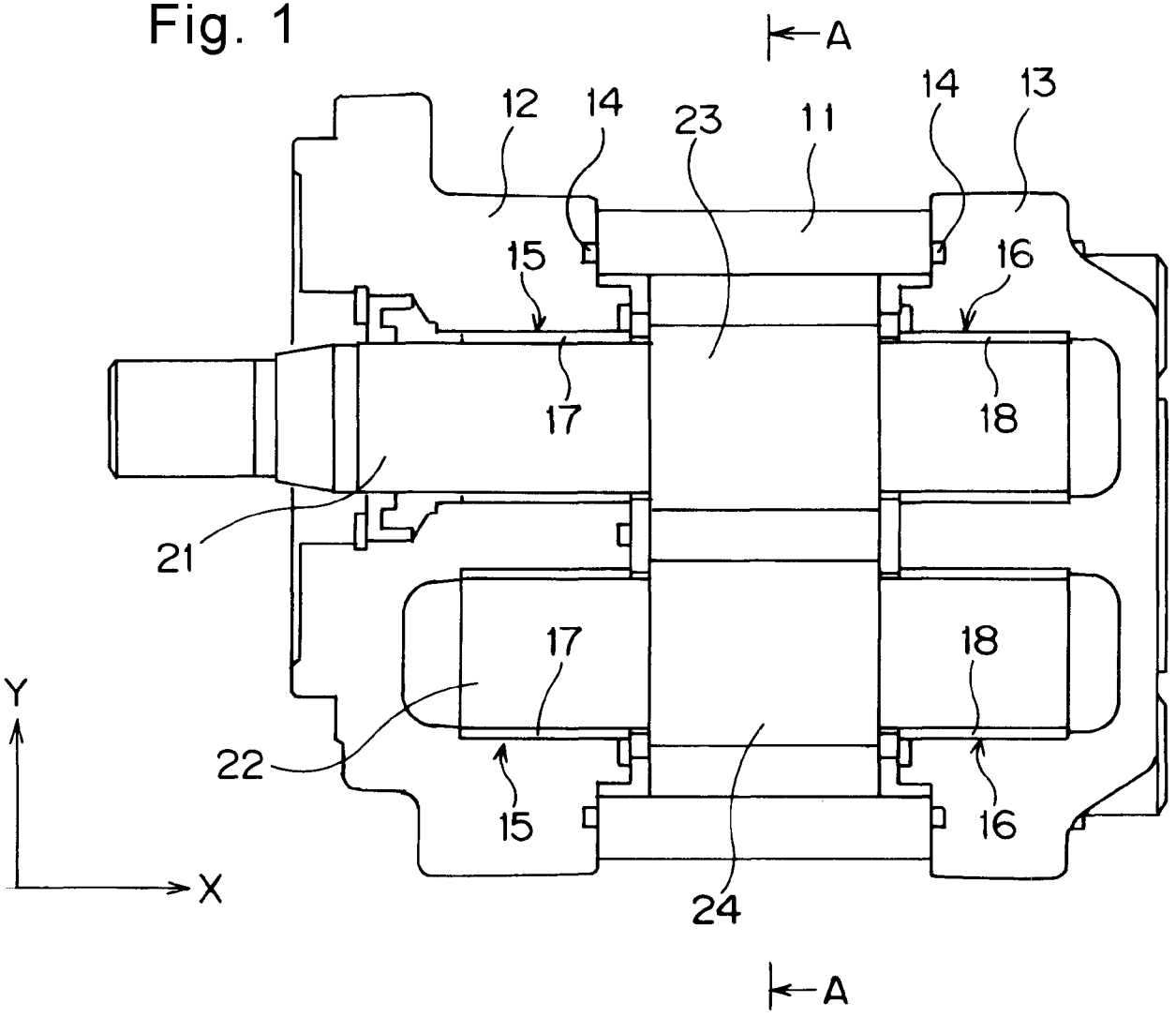
FIG. 1 is a longitudinal sectional view of a gear pump according to the first embodiment of the present invention.

Hereinafter, embodiments of the present invention are described, with reference to the drawings. FIG. 1 is a longitudinal sectional view of a gear pump according to the first embodiment of the present invention, and FIG. 2 is a cross sectional view of the gear pump taken along line A-A in FIG. 1.

The gear pump uses hydraulic oil as a hydraulic liquid, and serves as a hydraulic gear pump for sending the hydraulic oil by the operation of a pair of spur gears 23 and 24. The gear pump includes a body 11 held between a front cover 12 and a rear cover 13 via a gasket 14, and a pair of the spur gears 23 and 24 that mesh with each other and are housed in a hollow space 19 that is provided in the body 11 and is called as a spectacle-shaped hole. The spur gear 23 is fixed to a driving axle 21 that is rotated by a motor which is not shown. The spur gear 24 is fixed to a driven axle 22. Each of the driving axle 21 and the driven axle 22 has one end pivotally supported, via a bush 15, by a bearing hole 17 provided in the front cover 12, and the other end pivotally supported, via a bush 16, by a bearing hole 18 provided in the rear cover 13. The spur gears 23 and 24, meshing with each other, are individually rotated by the driving axle 21 in the direction indicated by the arrows in FIG. 2.

In a low-pressure area in the hollow space 19 provided in the body 11, where teeth of each of the paired spur gears 23 and 24 separate from each other, a suction passage 32 for supplying the hydraulic oil to the hollow space 19 is formed. In a high-pressure area in the hollow space 19 provided in the body 11, where teeth of each of the paired spur gears 23 and 24 mesh with each other, a discharge passage 33 for discharging the hydraulic oil from the hollow space 19 is formed. It should be noted that the discharge passage 33 may be formed to extend in an X direction that is the direction along the axle center of each of the driving axle 21 and the driven axle 22 (a direction perpendicular to the sheet of FIG. 2).

Figure 2:
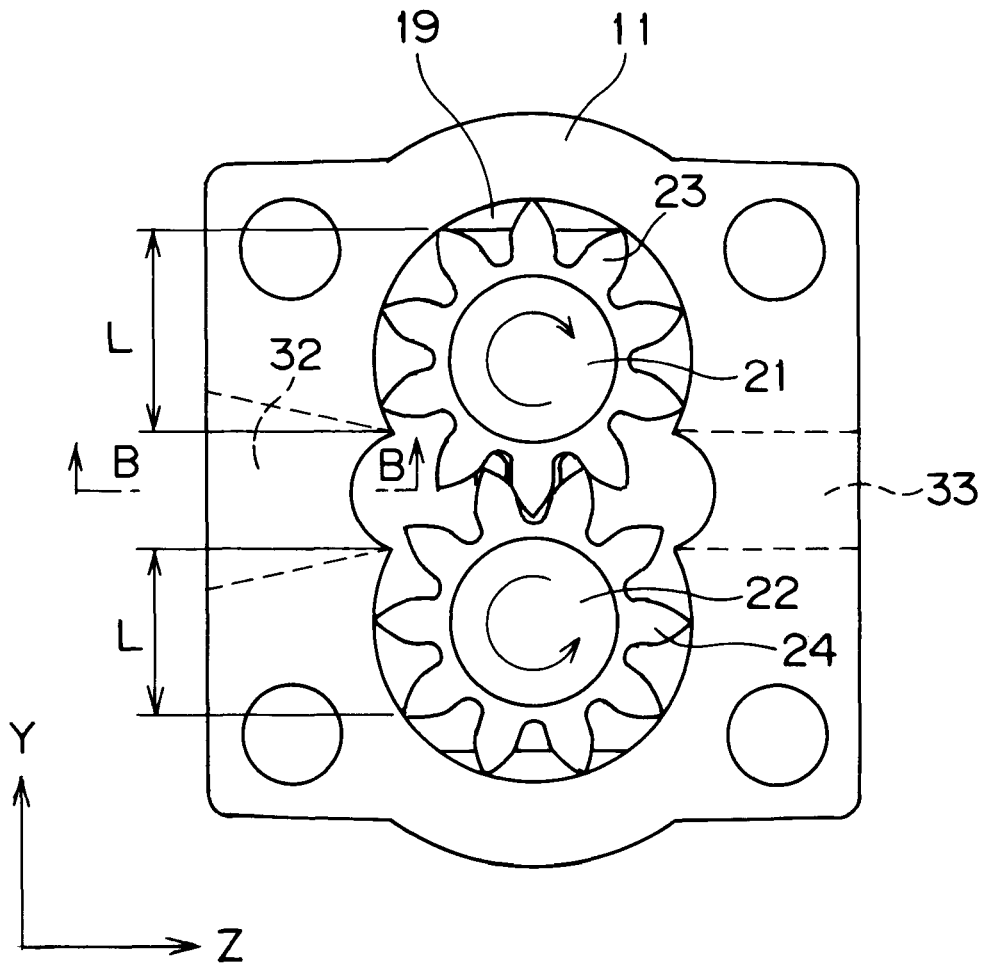
FIG. 2 is a cross sectional view of the gear pump, taken along line A-A in FIG. 1.
Figure 3:
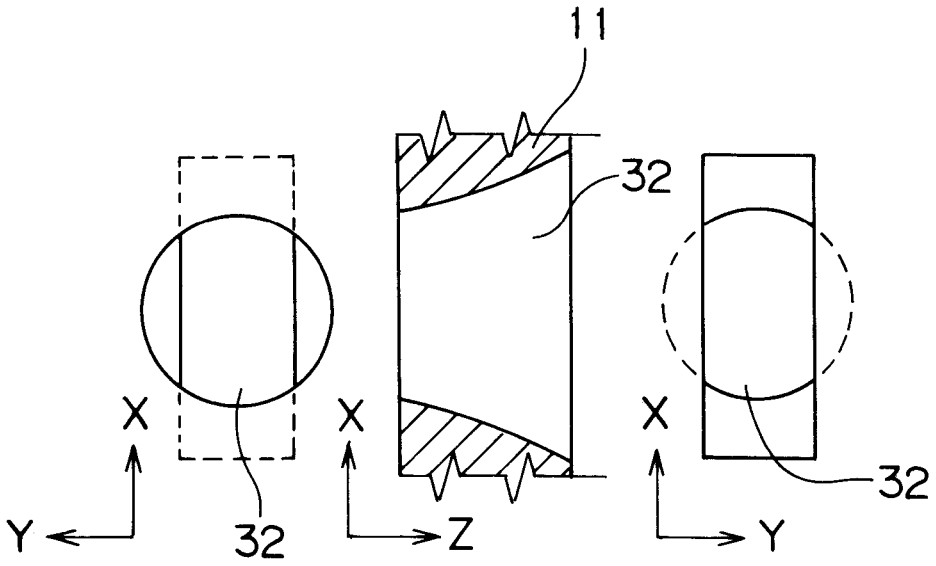
FIG. 3 is a cross sectional view taken along line B-B in FIG. 2, and shows a suction passage 32 viewed from a hollow space 19 and the outside of a body 11.
Figure 4:
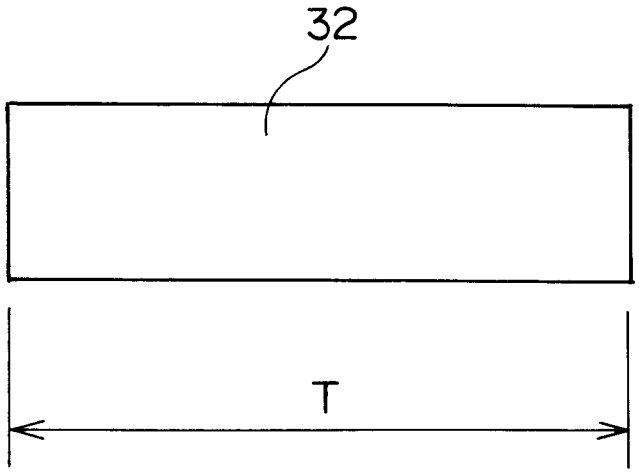
FIG. 4 is an explanation view indicating a shape of the suction passage 32 in a side close to the hollow space 19 in the body 11.

FIG. 3 is a cross sectional view taken along line B-B in FIG. 2, and shows the suction passage 32 viewed from the hollow space 19 (right side in FIG. 2) and the outside of the body 11 (left side in FIG. 2). FIG. 4 is an explanation view showing a shape of the suction passage 32 in a side close to the hollow space 19 in the body 11. The arrow T in FIG. 4 shows an area of the suction passage 32, which faces the spur gears 23 and 24.

As shown in these drawings, the cross section of the suction passage 32 has a rectangular shape viewed from the hollow space 19 side in the body 11, and has a circular shape viewed from the outside of the body 11 (a side from which the hydraulic oil is supplied). The suction passage 32 has a shape in which the rectangular shape in the hollow space 19 side in the body is smoothly connected with the circular shape in the outside of the body 11. As aforementioned, the shape of the suction passage 32 in the side from which the hydraulic oil is supplied is a circle, so that a commonly-used apparatus can be used when the suction passage 32 is connected to a supply tube or the like for supplying the hydraulic oil.

Regarding the rectangular shape of the suction passage 32 in the hollow space 19 side in the body 11, a dimension in a direction along the tooth width of the spur gears 23 and 24 (X direction) is larger than a dimension in a direction perpendicular to the direction along the tooth width of the spur gears 23 and 24 (Y direction). In other words, a long side of the rectangular extends in the direction along the tooth width of the spur gears 23 and 24, and a short side extends in the direction perpendicular to the tooth width direction.

Regarding the rectangular shape of the suction passage 32 in the hollow space 19 side in the body 11, the dimension in the direction along the tooth width of the spur gears 23 and 24 (the direction along the long side of the rectangular shape) is larger than the diameter of the opening of the suction passage 32 in the outside of the body 11, and a dimension in the direction perpendicular to the direction along the tooth width of the spur gears 23 and 24 (the direction along the short side of the rectangular shape) is smaller than the diameter of the opening of the suction passage 32 in the outside of the body 11.

The cross sectional area of the suction passage 32 from its opening in the outside of the body 11 (the side from which the hydraulic oil is supplied) to its opening with respect to the hollow space 19 is substantially constant.

The suction passage 32 has such a shape, to thereby increase its cross sectional area while adequately securing the sealing area L, which is shown in FIG. 2, between the inner peripheral face of the hollow space 19 and the tooth tips of the spur gears 23 and 24. Accordingly, it is possible to prevent the pump volumetric efficiency from deteriorating due to the reduction in flow rate of the hydraulic oil. In addition, it is possible to prevent the occurrence of defective suction, to thereby enable a prolonged product life.

The dimension, in the direction along the tooth width of the spur gears 23 and 24, of the opening of the suction passage 32 with respect to the hollow space 19 is increased, while the cross sectional area of the suction passage 32 is kept constant. This reduces the dimension, in the direction perpendicular to the tooth width direction, of the opening of the suction passage 32 with respect to the hollow space 19. Therefore, it is possible to efficiently enable the cross sectional area of the suction passage 32 to be increased while the sealing area L between the inner peripheral face of the hollow space 19 and the tooth tips of the spur gears 23 and 24 is secured.

In addition, the cross sectional area of the suction passage 32 from its opening in the side from which the hydraulic oil is supplied to its opening with respect to the hollow space 19 is substantially constant, thereby allowing the hydraulic oil to be smoothly supplied from the suction passage 32 to the hollow space 19.

In the aforementioned embodiment, the suction passage 32 has a shape in which the rectangular shape in the hollow space 19 side in the body 11 is smoothly connected with the circular shape in the outside of the body 11. Here, the suction passage 32 may have a shape in which the rectangular shape is stepwise connected with the circle. Alternatively, the suction passage 32 may have shapes other than the shape in which the rectangular shape is connected with the circle.

Figure 5:
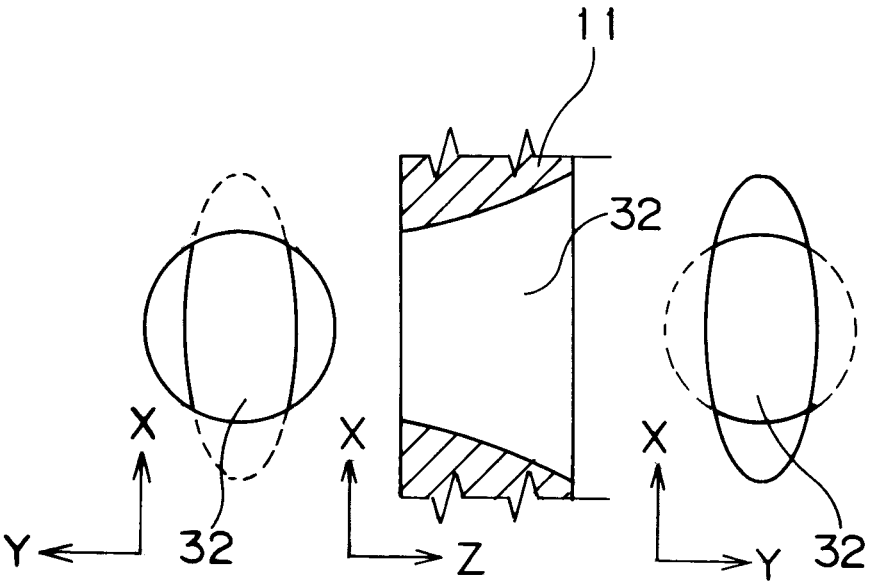
FIG. 5 is a cross sectional view taken along the line B-B in FIG. 2, and shows the suction passage 32 viewed from the hollow space 19 and the outside of the body 11 according to a first modification of the first embodiment of the present invention.
Figure 6:
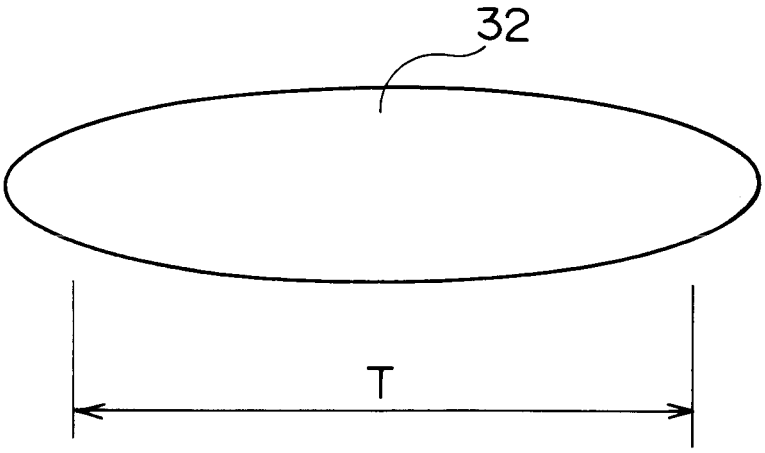
FIG. 6 is an explanation view indicating a shape of the suction passage 32 in a side close to the hollow space 19 in the body 11, according to the first modification of the first embodiment of the present invention.

FIG. 5 is a cross sectional view taken along line B-B in FIG. 2, according to a first modification of the first embodiment of the present invention, and shows the suction passage 32 viewed from the hollow space 19 and the outside of the body 11. FIG. 6 is an explanation view indicating a shape of the suction passage 32 in a side close to the hollow space 19 in the body 11, according to the first modification of the first embodiment of the present invention.

The suction passage 32 in the hollow space 19 side in the body 11 has a rectangular shape in the aforementioned first embodiment, whereas the suction passage 32 in the hollow space 19 side in the body 11 has an oval shape in this first modification. Other configurations are the same as those in the first embodiment.

If such a configuration is adopted, the shape of the suction passage 32 in the hollow space 19 side in the body 11 is close to the rectangular shape shown in FIG. 4, in an area that is indicated by the arrow T in FIG. 6 and faces the spur gears 23 and 24. Therefore, an effect close to those obtained in the embodiment shown in FIGS. 3 and 4 can be obtained.

Figure 7:
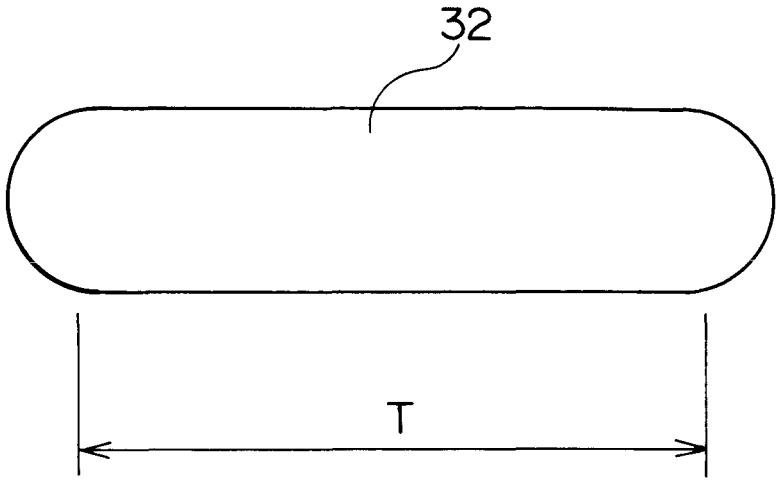
FIG. 7 is an explanation view indicating a shape of the suction passage 32 in the side close to the hollow space 19 in the body 11, according to a second modification of the first embodiment of the present invention.

FIG. 7 is an explanation view indicating a shape of the suction passage 32 in the side close to the hollow space 19 in the body 11, according to a second modification of the first embodiment of the present invention.

The suction passage 32 in the hollow space 19 side in the body 11 has the rectangular shape in the embodiment shown in FIG. 4, and the suction passage 32 in the hollow space 19 side in the body 11 has the oval shape in the first modification shown in FIG. 6. In this instance, in the second modification, the suction passage 32 in the hollow space 19 side in the body 11 has a shape in which a rectangular shape and a circular shape are combined. Other configurations are the same as those in the first embodiment.

If such a configuration is adopted, the shape of the suction passage 32 in the hollow space 19 side in the body 11 is similar to the rectangular shown in FIG. 4 in the area that is indicated by the arrow T in FIG. 6 and faces the spur gears 23 and 24. Therefore, an effect similar to those obtained in the embodiment shown in FIGS. 3 and 4 can be obtained.

Figure 8:
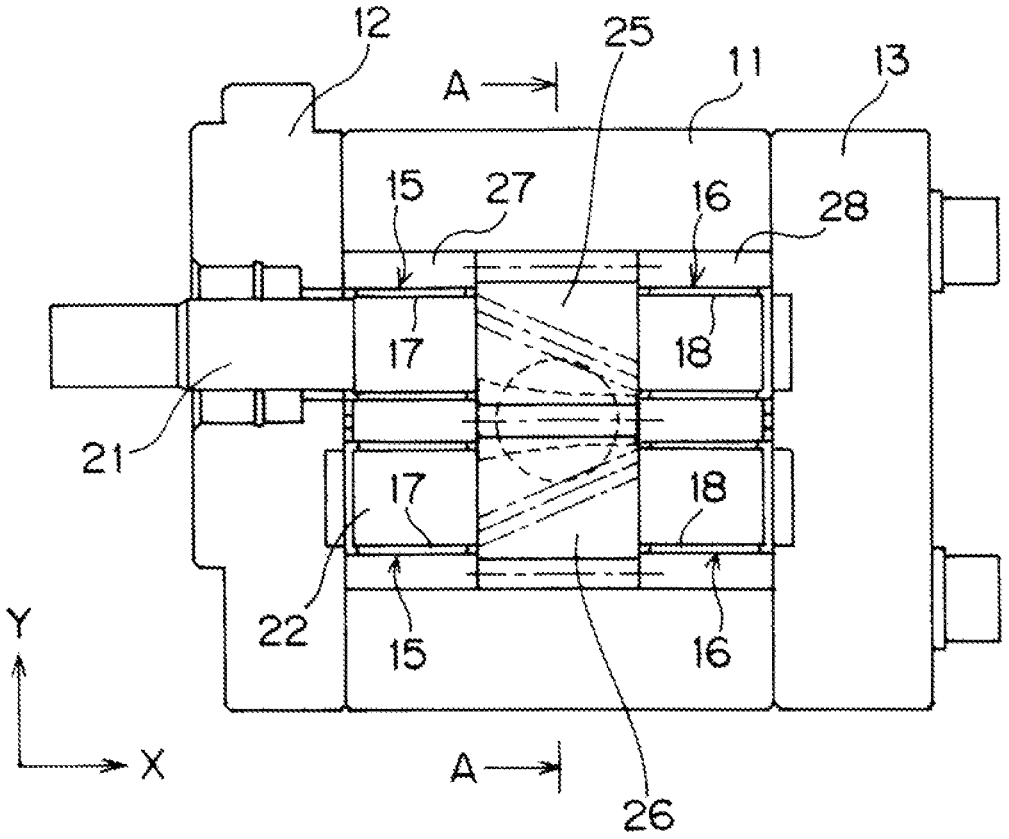
FIG. 8 is a longitudinal sectional view of a gear pump according to the second embodiment of the present invention.
Figure 9:
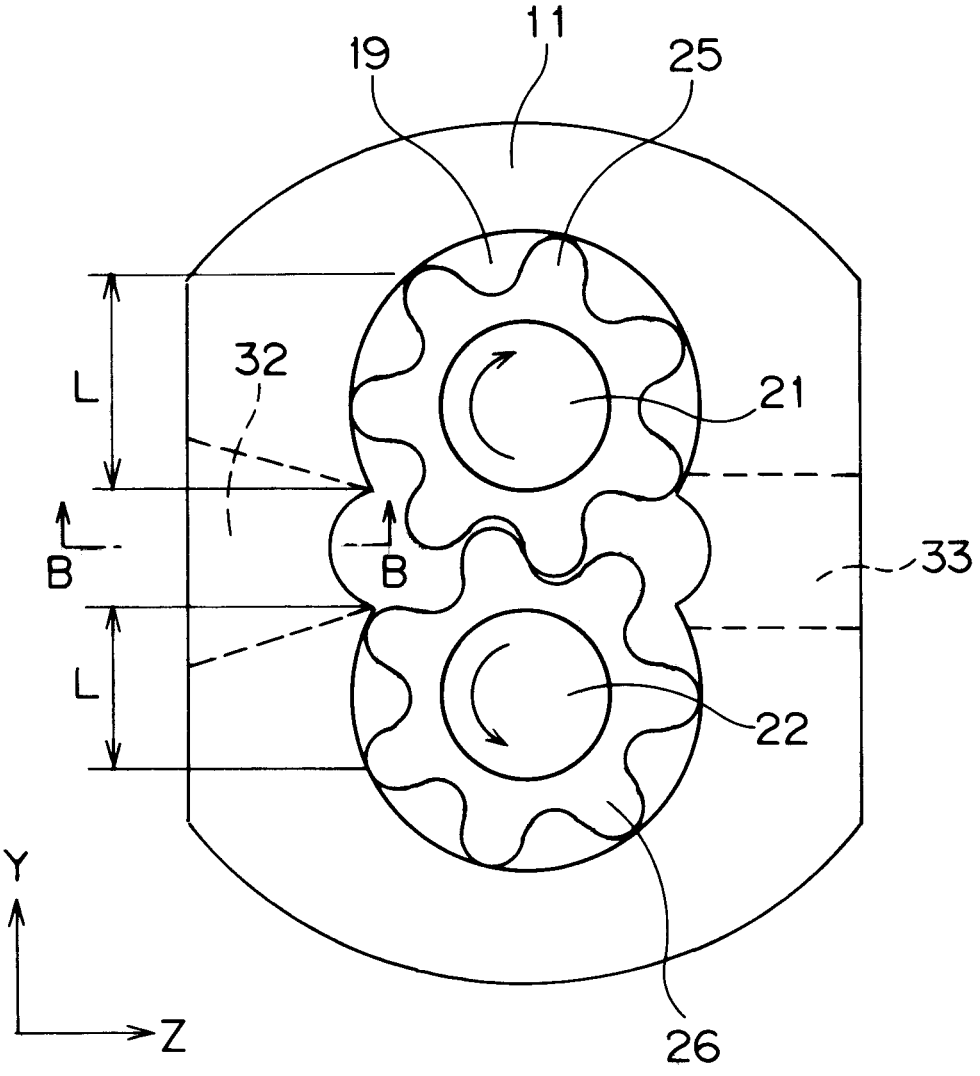
FIG. 9 is a cross sectional view of the gear pump, taken along line A-A in FIG. 8.

Subsequently, another embodiment of the present invention is described. FIG. 8 is a longitudinal sectional view of a gear pump according to the second embodiment of the present invention. FIG. 9 is a cross sectional view of the gear pump taken along line A-A in FIG. 8.

The gear pump uses hydraulic oil as the hydraulic liquid, and serves as a hydraulic gear pump for sending the hydraulic oil by operation of a pair of helical gears 25 and 26. The gear pump includes the body 11 held between the front cover 12 and the rear cover 13, a pair of the helical gears 25 and 26 that mesh with each other and are housed in the hollow space 19 that is provided in the body 11 and is called a spectacle-shaped hole, and side plates 27 and 28 that hold a pair of the helical gears 25, 26 in the hollow space 19. The helical gear 25 is fixed to the driving axle 21 that is rotated by a motor which is not shown. The helical gear 26 is fixed to the driven axle 22. Each of the driving axle 21 and the driven axle 22 has one end pivotally supported, via the bush 15, by the bearing hole 17 provided in the side plate 27, and the other end pivotally supported, via the bush 16, by the bearing hole 18 provided in the side plate 28. The helical gears 25 and 26, meshing with each other, are individually rotated by the driving axle 21 in the directions indicated by the arrows in FIG. 9.

In a low-pressure area in the hollow space 19 provided in the body 11, where teeth of each of the paired helical gears 25 and 26 separate from each other, the suction passage 32 for supplying the hydraulic oil to the hollow space 19 is formed. In a high-pressure area in the hollow space 19 provided in the body 11, where teeth of each of the paired helical gears 25 and 26 mesh with each other, the discharge passage 33 for discharging the hydraulic oil from the hollow space 19 is formed. It should be noted that the discharge passage 33 may be formed to extend in the X direction that is the direction along the axle center of each of the driving axle 21 and the driven axle 22 (a direction perpendicular to the sheet of FIG. 9).

Figure 10:
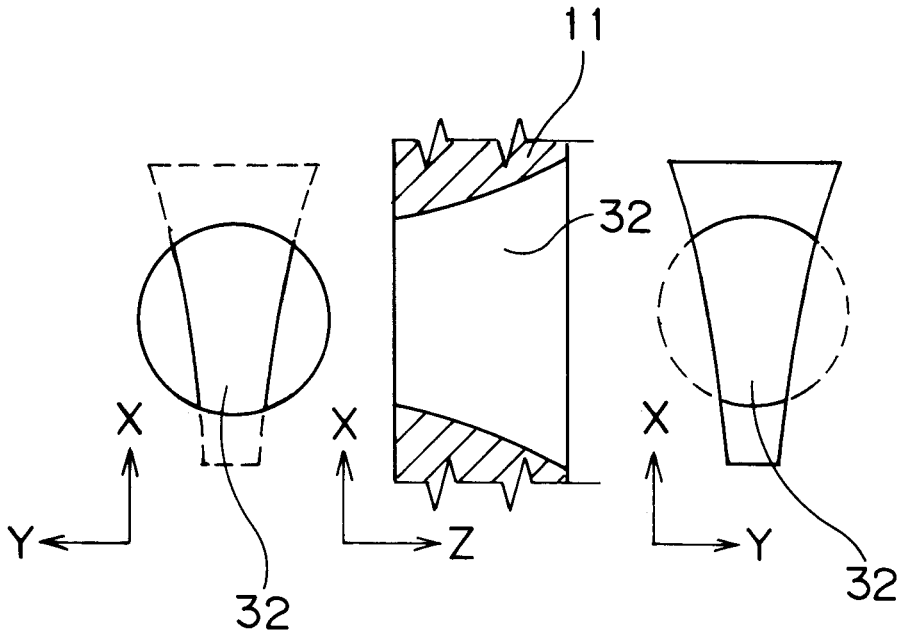
FIG. 10 is a cross sectional view taken along line B-B in FIG. 9, and shows the suction passage 32 viewed from the hollow space 19 and the outside of the body 11.
Figure 11:
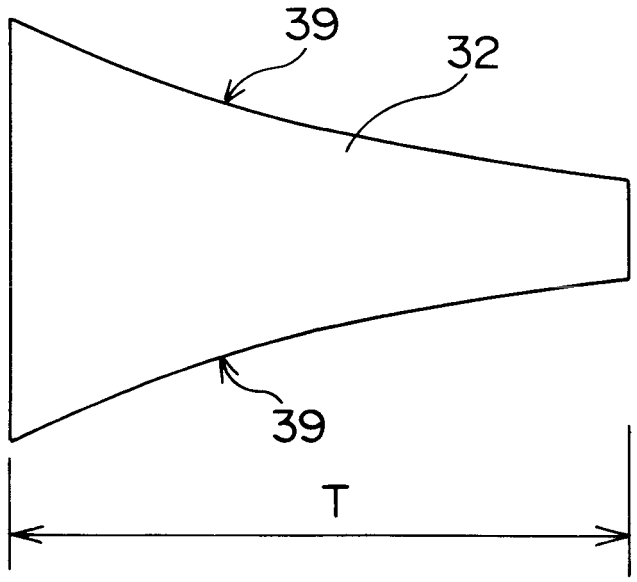
FIG. 11 is an explanation view indicating a shape of the suction passage 32 in the side close to the hollow space 19 in the body 11.

FIG. 10 is a cross sectional view taken along line B-B in FIG. 9, and shows the suction passage 32 viewed from the hollow space 19 (right side in FIG. 9) and the outside of the body 11 (left side in FIG. 9). FIG. 11 is an explanation view showing a shape of the suction passage 32 in a side close to the hollow space 19 in the body 11. The arrow T in FIG. 11 shows an area of the suction passage 32, which faces the helical gears 25 and 26.

As shown in FIG. 11, the cross section of the suction passage 32, in the hollow space 19 side in the body 11, is shaped as an opening having two sides that are opposite to each other and shaped in sine curves 39 with a shape corresponding to the tooth tip line of each of the helical gears 25 and 26, and the other two sides which are opposite to each other and shaped in straight lines. The opening is shaped such that in the area T that faces the helical gears 25 and 26, a dimension in a direction perpendicular to the direction along the tooth width of the helical gears 25 and 26 (Y direction shown in FIGS. 8, 9, and 10, and the vertical direction in FIG. 11) is larger in a side where the paired and meshed helical gears 25 and 26 separate from each other earlier in one tooth line, and is smaller in a side where the paired and meshed helical gears 25 and 26 separate from each other later in one tooth line. The cross section of the suction passage 32 has a circular shape in the outside of the body 11 (a side from which the hydraulic oil is supplied). The suction passage 32 has a shape in which the opening shape in the hollow space 19 side in the body 11 is smoothly connected with the circular shape in the outside of the body 11. As aforementioned, the shape of the suction passage 32 in the side from which the hydraulic oil is supplied is a circle, so that a commonly-used apparatus can be used when the suction passage 32 is connected to a supply tube or the like for supplying the hydraulic oil.

Regarding the opening of the suction passage 32 in the side close to the hollow space 19 in the body 11, a dimension in a direction along the tooth width of the helical gears 25 and 26 (X direction) is larger than a dimension in a direction perpendicular to the tooth width of the helical gears 25 and 26 (Y direction).

Regarding the opening of the suction passage 32 in the side close to the hollow space 19 in the body 11, the dimension in the direction along the tooth width of the helical gears 25 and 26 is larger than the diameter of the opening of the suction passage 32 in the outside of the body 11, and the dimension in the direction perpendicular to the direction along the tooth width of the helical gears 25 and 26 is smaller than the diameter of the opening of the suction passage 32 in the outside of the body 11.

The cross sectional area of the suction passage 32 from its opening part in the outside of the body 11 (the side from which the hydraulic oil is supplied) to the opening part with respect to the hollow space 19 is substantially constant.

The opening of the suction passage 32 has two sides that are the sine curves 39 corresponding to the tooth tip line of the helical gears 25 and 26, to thereby increase the cross sectional area of the suction passage 32 while adequately securing the sealing area L, which is shown in FIG. 9, between the inner peripheral face of the hollow space 19 and the tooth tips of the helical gears 25 and 26. Accordingly, it is possible to prevent the pump volumetric efficiency from deteriorating due to the reduction in flow rate of the hydraulic oil. In addition, it is possible to prevent the occurrence of defective suction, to thereby enable a prolonged product life.

The dimension, in the direction along the tooth width of the helical gears 25 and 26, of the opening of the suction passage 32 with respect to the hollow space 19 is increased, while the cross sectional area of the suction passage 32 is kept constant. This reduces the dimension, in the direction perpendicular to the tooth width direction, of the opening of the suction passage 32 with respect to the hollow space 19. Therefore, it is possible to efficiently enable the configuration in which the cross sectional area of the suction passage 32 is increased while the sealing area L between the inner peripheral face of the hollow space 19 and the tooth tips of the helical gears 25 and 26 is secured.

The cross sectional area of the suction passage 32 from its opening in the side from which the hydraulic oil is supplied to the opening with respect to the hollow space 19 is substantially constant, thereby allowing the hydraulic oil to be smoothly supplied from the suction passage 32 to the hollow space 19.

The opening, which is shown in FIG. 11, of the suction passage 32 in the hollow space 19 side in the body 11 is shaped such that opposite ends of the opening in the direction along the tooth width of the helical gears 25 and 26 define straight lines respectively, in the area that faces the helical gears 25 and 26. However, the opposite ends of the opening may respectively define curves extending from the area that faces the helical gears 25 and 26 to the outside of the body 11.

Figure 12:
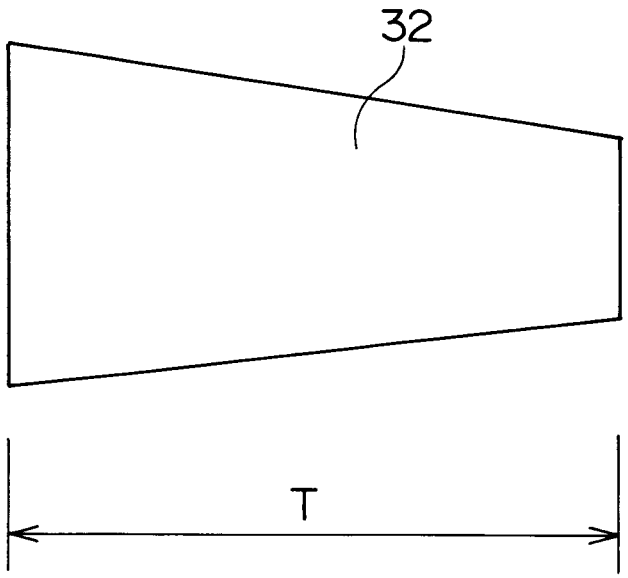
FIG. 12 is an explanation view indicating a shape of the suction passage 32 in the side close to the hollow space 19 in the body 11, according to a modification of the second embodiment of the present invention.

FIG. 12 is an explanation view indicating a shape of the suction passage 32 in the side close to the hollow space 19 in the body 11, according to a modification of the second embodiment of the present invention.

The shape of the opening of the suction passage 32 in the hollow space 19 side in the body 11 has two sides shaped in the sine curves 39 each corresponding to the tooth tip line of the helical gears 25 and 26 in the aforementioned second embodiment. Here, the two sides are shaped in straight lines in the modification. Other configurations are the same as those in the second embodiment.

If such a configuration is adopted, the shape of the suction passage 32 in the hollow space 19 side in the body 11 is close to the opening shape shown in FIG. 11. Therefore, an effect close to those obtained in the embodiment shown in FIG. 11 can be obtained.

Figure 13:
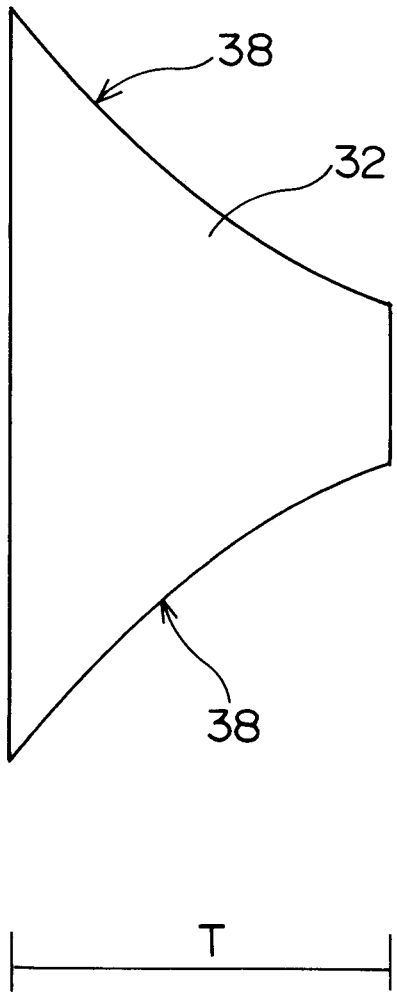
FIG. 13 is an explanation view indicating a shape of the suction passage 32 in the side close to the hollow space 19 in the body 11, according to another modification of the second embodiment of the present invention.
Figure 14:
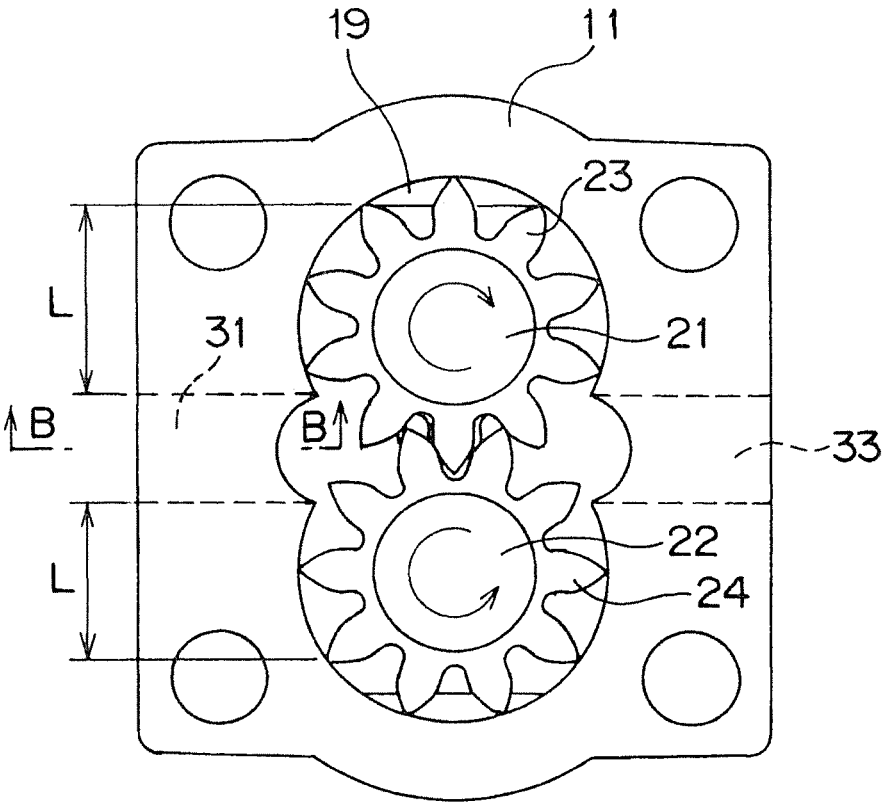
FIG. 14 is a sectional side view around a body 11 of a traditional gear pump.
Figure 15:
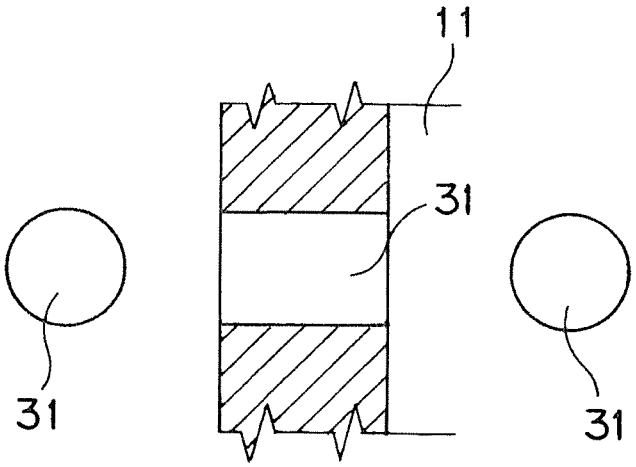
FIG. 15 is a cross sectional view taken along line B-B in FIG. 14, and shows the suction passage 31 viewed from the hollow space 19 and the outside of the body 11.

FIG. 13 is an explanation view indicating a shape of the suction passage 32 in a side close to the hollow space 19 in the body 11, according to another modification of the second embodiment of the present invention.

The capacity of the gear pump, for example, may cause the tooth tip line of the helical gears 25 and 26 to have a large angle with respect to the direction along the tooth width of the helical gears 25 and 26. In such a case, the cross sectional area of the suction passage 32 in the hollow space 19 side in the body 11 has two opposite sides that are sine curves 38 each of which has a large angle with respect to the direction along the tooth width of the helical gears 25 and 26. The sine curves 38 correspond to the tooth tip line of the helical gears 25 and 26. In this case, in the opening shape of the suction passage 32 in the side close to the hollow space 19 in the body 11, a dimension in the direction along the tooth width of the helical gears 25 and 26 (X direction) is smaller than a dimension in a direction (Y direction) perpendicular to the direction along the tooth width of the helical gears 25 and 26, unlike the aforementioned embodiment.

However, even in the case where such a configuration is adopted, the two opposite sides of the cross section of the suction passage 32 define the sine curves 38 that correspond to the tooth tip line of each of the helical gears 25 and 26. Accordingly, the cross sectional shape of the suction passage 32 matches the tooth tip line of the helical gears 25 and 26, to thereby enable the increase in the cross sectional area of the suction passage for securing a sealing area.

In the gear pumps according to the first and second embodiments mentioned earlier, hydraulic oil having pressure higher than that of the discharge passage 33 can be introduced. This takes a rotary torque from the driving axle 21 and allows the gear pump to function as a gear motor exhibiting a motor effect in which an external load is driven, and the hydraulic oil that has a low pressure is discharged from the suction passage 32. In other words, the gear pump according to each of the embodiments mentioned earlier also serves as a gear motor.

Although hydraulic oil is used as the hydraulic liquid in the first and second embodiments mentioned earlier, a hydraulic liquid other than hydraulic oil, such as other liquids, fluids and semiliquids, can be used.

REFERENCE SIGNS LIST

11 . . . Body
12 . . . Front Cover
13 . . . Rear Cover
15 . . . Bush
16 . . . Bush
17 . . . Bearing Hole
18 . . . Bearing Hole
19 . . . Hollow Space
21 . . . Driving Axle
22 . . . Driven Axle
23 . . . Spur Gear
24 . . . Spur Gear
25 . . . Helical Gear
26 . . . Helical Gear
32 . . . Suction Passage
33 . . . Discharge Passage
38 . . . Sine Curve
39 . . . Sine Curve

The invention claimed is:

1. A gear pump or a motor comprising:

a pair of gears housed in a hollow space provided in a body, in a state where each gear of the pair of gears meshes with each other;

a suction passage for supplying a hydraulic liquid to the hollow space, the suction passage having a first opening in communication with the hollow space and a second opening from which the hydraulic liquid is supplied; and a discharge passage for discharging the hydraulic liquid from the hollow space, wherein a dimension of the first opening in a direction along a tooth width of the gear is larger than a dimension of the first opening in a direction perpendicular to the direction along the tooth width of the gear, and a cross sectional area of the suction passage is constant from the second opening to the first opening.

2. The gear pump or the motor according to claim 1, wherein the dimension of the first opening in the direction along the tooth width of the gear is larger than a dimension of the second opening in the direction along the tooth width of the gear, and the dimension of the first opening in the direction perpendicular to the direction along the tooth width of the gear is smaller than a dimension of the second opening in the direction perpendicular to the direction along the tooth width of the gear.

3. The gear pump or the motor according to claim 2, wherein the second opening is shaped in a circle, the dimension of the first opening in the direction along the tooth width of the gear is larger than a diameter of the circle, and the dimension of the first opening in the direction perpendicular to the direction along the tooth width of the gear is smaller than the diameter of the circle.

4. The gear pump or the motor according to claim 1, wherein the gear is a spur gear, and the first opening has opposite ends with respect to a direction perpendicular to a direction along a tooth width of the spur gear parallel to tooth tip line of the spur gear in an area facing the spur gear.

5. The gear pump or the motor according to claim 1, wherein the gear is a helical gear, and the dimension of the first opening in a direction perpendicular to a direction along a tooth width of the helical gear is larger in a side where helical gears which are paired and mesh with each other separate earlier and smaller in a side where the paired helical gears meshing with each other separate later, in an area facing the helical gears.

6. The gear pump or the motor according to claim 5, wherein the first opening has opposite ends with respect to the direction perpendicular to the direction along the tooth width of the helical gears, each of the opposite ends being is shaped in a sine curve, in an area facing the helical gears.

7. A gear pump or a motor comprising:

a pair of helical gears housed in a hollow space provided in a body, in a state where the helical gears mesh with each other;

a suction passage for supplying a hydraulic liquid to the hollow space, the suction passage having a first opening in communication with the hollow space and a second opening from which the hydraulic liquid is supplied; and a discharge passage for discharging the hydraulic liquid from the hollow space, wherein a dimension of the first opening in a direction perpendicular to a direction along a tooth width of the helical gears is larger in a side where the helical gears that are paired and mesh with each other separate earlier and smaller in a side where the paired helical gears meshing with each other separate later, in an area facing the helical gears, and a cross sectional area of the suction passage is constant from the second opening to the first opening.

8. The gear pump or the motor according to claim 7, wherein the first opening has opposite ends with respect to the direction perpendicular to the direction along the tooth width of the helical gears, each of the opposite ends is shaped in a sine curve, in an area facing the helical gears.

* * * * *